US011804173B1

(12) United States Patent
Pyo

(10) Patent No.: US 11,804,173 B1
(45) Date of Patent: Oct. 31, 2023

(54) DISPLAY DEVICE AND DRIVING METHOD THEREOF

(71) Applicant: Samsung Display Co., Ltd., Yongin-Si (KR)

(72) Inventor: Si Beak Pyo, Yongin-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

(21) Appl. No.: 17/947,219

(22) Filed: Sep. 19, 2022

(30) Foreign Application Priority Data

Apr. 11, 2022 (KR) ..... 10-2022-0044511

(51) Int. Cl.
*G09G 3/32* (2016.01)

(52) U.S. Cl.
CPC ..... *G09G 3/32* (2013.01); *G09G 2310/08* (2013.01); *G09G 2320/0626* (2013.01)

(58) Field of Classification Search
CPC ..... G09G 3/32; G09G 2310/08; G09G 2320/0626
See application file for complete search history.

(56) References Cited

U.S. PATENT DOCUMENTS 9,135,887 B2 9/2015 Jun et al.
9,953,573 B2 4/2018 Pyo et al.
10,810,942 B2 10/2020 Pyo et al.
11,017,727 B2 5/2021 Pyo
2010/0302595 A1* 12/2010 Yamada ..... H04N 1/00082 358/1.18
2016/0189676 A1 6/2016 Pyo
2016/0210900 A1* 7/2016 Kim ..... G09G 3/3266
2018/0082625 A1* 3/2018 Yang ..... G09G 3/3275
2021/0035488 A1* 2/2021 Seo ..... G09G 3/2092

FOREIGN PATENT DOCUMENTS

KR 10-1961424 B1 3/2019
KR 10-2019-0064200 A 6/2019
KR 10-2021-0001047 A 1/2021

* cited by examiner

*Primary Examiner* — Muhammad N Edun
(74) *Attorney, Agent, or Firm* — Innovation Counsel LLP

(57) ABSTRACT

A display device includes a light emitting element, a timing controller, and an initialization power generator. The timing controller determines whether a second image associated with a second frame is different from a first image associated with a first frame. The second frame immediately follows the first frame. The initialization power generator is electrically connected to the timing controller, provides a reference voltage for initializing the light emitting element in the second frame when/if the second image is identical to the first image, and provides a first adjusted voltage unequal to the reference voltage for initializing the light emitting element in the second frame when/if the second image is different from the first image.

19 Claims, 10 Drawing Sheets

FIG. 5

| CRITERION | | OFFSET VOLTAGE |
|---|---|---|
| APL | 0% | 0.5 V |
| | 1~10% | 0.2 V |
| | 10~30% | 0.1 V |
| | 30~100% | 0 V |
| BLACK RATE | 90~100% | 0.2 V |
| | 40~90% | 0.1 V |
| | 10~40% | 0.05 V |
| | 10%↓ | 0 V |

FIG. 6

| Frame | WEIGHT SETTING | IMAGE ANALYSIS | | | | | WEIGHT CALCULATION | |
|---|---|---|---|---|---|---|---|---|
| | | APL | | Black portion | | SELECTED OFFSET VOLTAGE[V] | WEIGHT REFLECTION | WEIGHT REFLECTED OFFSET VOLTAGE[V] |
| | | % | OFFSET VOLTAGE[V] | % | OFFSET VOLTAGE[V] | | | |
| N−5 | 10% | 87 | 0 | 10 | 0 | 0 | 0 | 0.38 |
| N−4 | 10% | 35 | 0 | 50 | 0.05 | 0.05 | 0.005 | |
| N−3 | 10% | 10 | 0.2 | 90 | 0.1 | 0.2 | 0.02 | |
| N−2 | 30% | 0 | 0.5 | 100 | 0.2 | 0.5 | 0.15 | |
| N−1 | 40% | 0 | 0.5 | 100 | 0.2 | 0.5 | 0.2 | |

DISPLAY DEVICE AND DRIVING METHOD THEREOF

CROSS-REFERENCE TO RELATED APPLICATION

The present application claims priority under 35 U.S.C. § 119(a) to Korean patent application No. 10-2022-0044511 filed on Apr. 11, 2022 in the Korean Intellectual Property Office; the Korean patent application is incorporated by reference.

BACKGROUND

1. Technical Field

The technical field relates to a display device and a driving method of the display device.

2. Related Art

A display device may include pixels for displaying an image. Each of the pixels may include a light emitting element. For display an image, the display device initializes (or discharges) a parasitic capacitor associated with the light emitting element of a pixel using a specific initialization voltage before the display device applies a data signal to the pixel. A discharge characteristic of the pixel (particularly, the parasitic capacitor) may vary according to a voltage difference between the initialization voltage and a low-potential driving voltage (ELVSS). When the voltage difference is excessive in a forward bias direction, black is displayed. When the voltage difference is excessive in a reverse bias direction, light emission is delayed, and/or a color dragging phenomenon occurs. Therefore, the quality of a moving image may be unsatisfactory.

SUMMARY

Embodiments may be related a display device capable of displaying moving images with satisfactory quality.

Embodiments may be related to a driving method of a display device for displaying moving images with satisfactory quality.

In accordance with embodiments, a display device may include the following elements: a pixel configured to initialize a light emitting element by using a voltage of a first initialization power source; a timing controller configured to check whether an image has been changed for each frame; and an initialization power generator configured to, when the image is changed, change and output the voltage of the first initialization power source during a first frame period of the changed image.

The voltage of the first initialization power source may initialize an anode electrode of the light emitting element.

The timing controller may include: an image analysis unit configured to calculate an Average Picture Level (APL) and a black rate of a current frame; an offset voltage setting unit configured to set an offset voltage by selecting any one of predetermined offset voltages corresponding to each of the calculated APL and the calculated black rate; and an image comparison unit configured to generate a first initialization power control signal or a second initialization power control signal by checking whether images of the current frame and a next frame have been changed.

The image analysis unit may further calculate an APL and a black rate of at least one previous frame. The offset voltage setting unit may select any one of predetermined offset voltages corresponding to each of the calculated APL and the calculated black rate, and set an offset voltage by multiplying the selected offset voltages by a predetermined weight and then adding the offset voltages multiplied by the predetermined weight together.

When a first initialization power control signal corresponding to an image change is transferred from the image comparison unit, the initialization power generator may add the offset voltage to a reference voltage and output the reference voltage to which the offset voltage is added as the voltage of the first initialization power source during a first frame of the changed image.

When a second initialization power control signal corresponding to image consistency is transferred from the image comparison unit, the initialization power generator may output the reference voltage as the voltage of the first initialization power source during a next frame period.

When a first initialization power control signal corresponding to an image change is transferred from the image comparison unit, the initialization power generator may change and output the voltage of the first initialization power source during at least two frame periods including the first frame of the changed image.

The initialization power generator may gradually increase the voltage of the first initialization power source until a predetermined offset frame.

The initialization power generator may add the offset voltage to a reference voltage and output the reference voltage to which the offset voltage is added as the voltage of the first initialization power source during a predetermined offset frame period.

The initialization power generator may gradually decrease the voltage of the first initialization power source down to the reference voltage during at least two frame periods after the predetermined offset frame.

Embodiments may be related to a method of driving a display device including a pixel for initializing a light emitting element by using a voltage of a first initialization power source. The method may include the following phrases/steps: a first phase of calculating an Average Picture Level (APL) and a black rate of a current frame; a second phase of setting an offset voltage by selecting any one of predetermined offset voltages corresponding to each of the calculated APL and the calculated black rate; a third phase of generating a first initialization power control signal or a second initialization power control signal by checking whether images of the current frame and a next frame have been changed; and a fourth phase of, when the image is changed, changing and outputting the voltage of the first initialization power source according to the first initialization power control signal during a first frame period of the changed image.

The voltage of the first initialization power source may initialize an anode electrode of the light emitting element.

In the first phase, an APL and a black rate of at least one previous frame may be further calculated. In the second phase, any one of predetermined offset voltages corresponding to each of the calculated APL and the calculated black rate may be selected, and an offset voltage may be set by multiplying the selected offset voltages by a predetermined weight and then adding the offset voltages multiplied by the predetermined weight together In the fourth phase, the offset voltage may be added to a reference voltage, and the reference voltage to which the offset voltage is added may be output as the voltage of the first initialization power source during a first frame of the changed image.

In the fourth phase, when the image is not changed, the reference voltage may be output as the voltage of the first initialization power source according to the second initialization power control signal during a next frame period.

In the fourth phase, the voltage of the first initialization power source may be changed and output during at least two frame periods including the first frame of the changed image.

In the fourth phase, the voltage of the first initialization power source may be gradually increased until a predetermined offset frame.

In the fourth phase, the offset voltage may be added to a reference voltage, and the reference voltage to which the offset voltage is added may be output as the voltage of the first initialization power source during a predetermined offset frame period.

In the fourth phase, the voltage of the first initialization power source may be gradually decreased down to the reference voltage during at least two frame periods after the predetermined offset frame.

An embodiment may be related to a display device. The display device may include a light emitting element, a timing controller, and an initialization power generator. The timing controller may determine whether a second image associated with a second frame is different from a first image associated with a first frame. The second frame immediately follows the first frame. The initialization power generator may be electrically connected to the timing controller, may provide a reference voltage for initializing the light emitting element in the second frame when/if the second image is identical to the first image, and may provide a first adjusted voltage unequal to the reference voltage for initializing the light emitting element in the second frame when/if the second image is different from the first image.

The reference voltage or the first adjusted voltage may initialize an anode electrode of the light emitting element.

The timing controller may include the following elements: an image analysis unit configured to calculate an average brightness value of the first image and a black rate of the first image; an adjustment voltage setting unit configured to determine a first adjustment voltage by at least selecting one adjustment voltage corresponding to each of the average brightness value of the first image and the black rate of the first image, wherein the first adjusted voltage may be a function of the reference voltage and the first adjustment voltage; and an image comparison unit configured to generate a first signal when the second image is different from the first image and configured to generate a second signal when the second image is identical to the first image.

The image analysis unit may calculate at least one average brightness value and at least one black rate of at least a third image associated with at least one frame preceding the first frame. The adjustment voltage setting unit may select at least one adjustment voltage corresponding to each of the at least one average brightness value and the at least one black rate, may multiply selected adjustment voltages associated with the first image and at least the third image by predetermined weights to calculate weighted adjustment voltages, and may add the weighted adjustment voltages to obtain the first adjustment voltage.

In response to the first signal received from the image comparison unit, the initialization power generator may add the first adjustment voltage to the reference voltage to obtain the first adjusted voltage.

In response to the second signal received from the image comparison unit, the initialization power generator may output the reference voltage in the second frame.

In response to the first signal received from the image comparison unit, the initialization power generator may output the first adjusted voltage and a second adjusted voltage for the second frame and a third frame, respectively. The third frame may be subsequent to the second frame. The second adjusted voltage may be unequal to each of the reference voltage and the first adjusted voltage.

The first adjusted voltage may be greater than the reference voltage. The second adjusted voltage may be greater than the first adjusted voltage.

The initialization power generator may add different adjustments that are less than or equal to a predetermined adjustment voltage to the reference voltage to generate different adjusted voltages for initializing the light emitting element with the different adjusted voltages in the second frame and at least the third frame.

The initialization power generator may subtract different deductions that may be less than or equal to the predetermined adjustment voltage from the second adjusted voltage to generate different reduced voltages for initializing the light emitting element during at least two frames that are subsequent to the third frame.

An embodiment may be related to method of driving a display device. The display device may include a light emitting element. The method may include the following steps: calculating an average brightness value of a first image and a black rate of the first image, the first image being associated with a first frame; determining a first adjustment voltage by at least selecting one adjustment voltage corresponding to each of the average brightness value of the first image and the black rate of the first image; determining whether a second image associated with a second frame immediately following the first image is different from the first image; generating a first signal when the second image is different from the first image, or generating a second signal when the second image is identical to the first image; and providing a reference voltage for initializing the light emitting element in the second frame in response to the second signal, or providing a first adjusted voltage unequal to the reference voltage for initializing the light emitting element in the second frame in response to the first signal.

The reference voltage or the first adjusted voltage may initialize an anode electrode of the light emitting element.

The method may include the following steps: calculating at least one average brightness value and at least one black rate of at least a third image associated with at least one frame preceding the first frame; selecting at least one adjustment voltage corresponding to each of the at least one average brightness value and the at least one black rate; multiplying selected adjustment voltages associated with the first image and at least the third image by predetermined weights to calculate weighted adjustment voltages; and adding the weighted adjustment voltages to obtain a first adjustment voltage. The first adjusted voltage may be a function of the reference voltage and the first adjustment voltage.

The method may include adding a first adjustment voltage to the reference voltage to obtain the first adjusted voltage in response to first signal The method may include providing the reference voltage for initializing the light emitting element when a third image associated with a third frame immediately following the second frame is identical to the second image.

The method may include, in response to the first signal, outputting the first adjusted voltage and a second adjusted voltage for the second frame and a third frame, respectively. The third frame may be subsequent to the second frame. The second adjusted voltage may be unequal to each of the reference voltage and the first adjusted voltage.

The first adjusted voltage may be greater than the reference voltage. The second adjusted voltage may be greater than the first adjusted voltage.

The method may include adding different adjustments that are less than or equal to a predetermined adjustment voltage to the reference voltage to generate different adjusted voltages for initializing the light emitting element with the different adjusted voltages in the second frame and at least the third frame.

The method may include subtracting different reductions that are less than or equal to the predetermined adjustment voltage from the second adjusted voltage to generate different reduced voltages for initializing the light emitting element during at least two frames that are subsequent to the third frame.

BRIEF DESCRIPTION OF THE DRAWINGS

FIG. 5 is a table illustrating offset voltage values corresponding to ranges of possible values resulted from an image calculation in accordance with embodiments.

FIG. 6 is a table illustrating an offset voltage corresponding to values resulted from an image calculation in accordance with embodiments.

DETAILED DESCRIPTION

Figure 1:
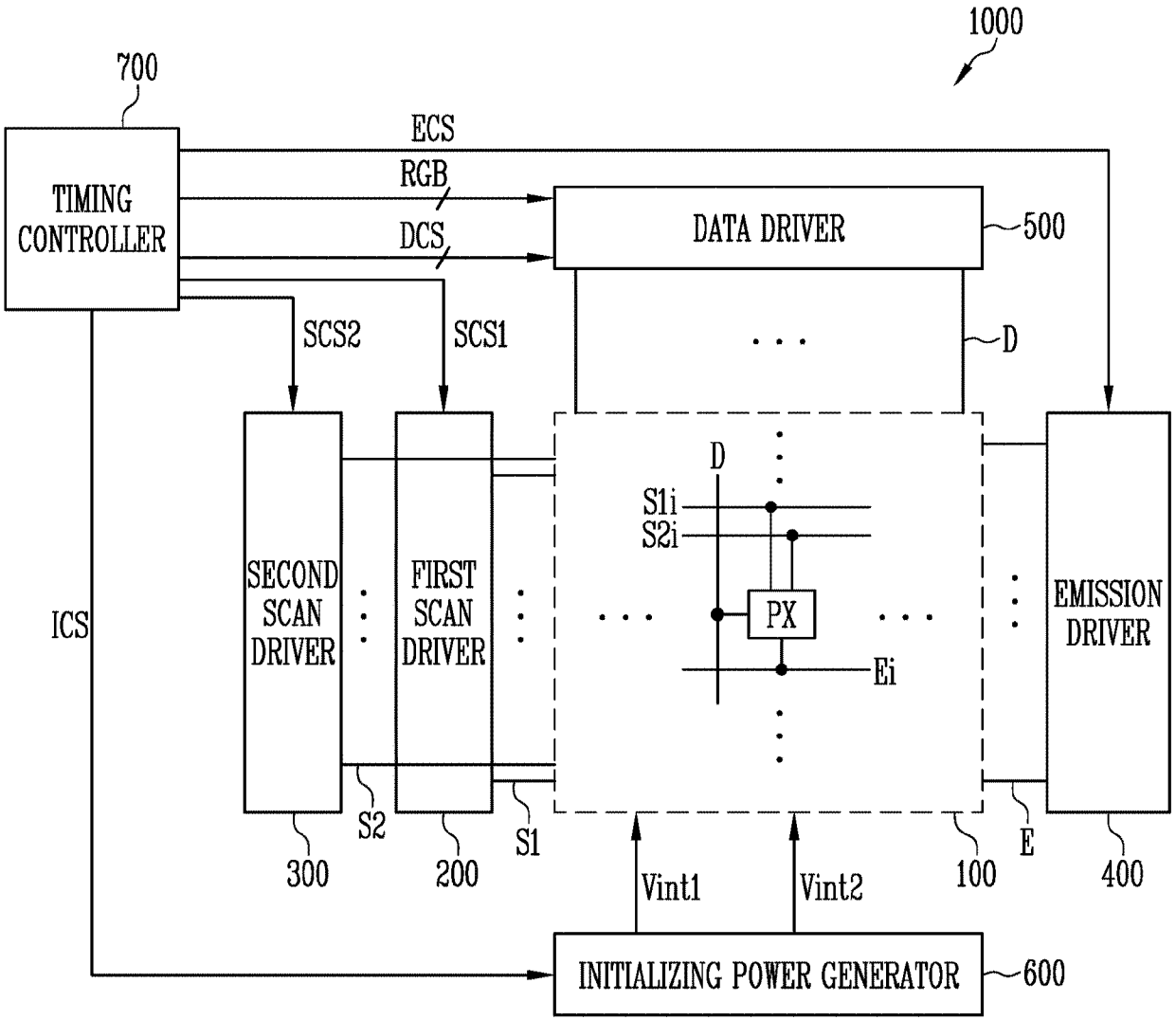
FIG. 1 is a block diagram illustrating a display device in accordance with embodiments.

Examples of embodiments are described with reference to the drawings. Various changes may be applicable to the examples. The examples do not limit the scope of the disclosure.

Like numbers may refer to like elements in the description and the drawings. In the drawings, dimensions may be exaggerated for clarity.

Although the terms "first," "second," etc. may be used to describe various elements, these elements should not be limited by these terms. These terms may be used to distinguish one element from another element. Thus, a "first" element discussed below could also be termed a "second" element without departing from the teachings of the present disclosure. The description of an element as a "first" element may not require or imply the presence of a second element or other elements. The terms "first," "second," etc. may be used to differentiate different categories or sets of elements. For conciseness, the terms "first," "second," etc. may represent "first-category (or first-set)," "second-category (or second-set)," etc., respectively.

The singular forms may represent the plural forms as well, unless the context clearly indicates otherwise.

The terms "comprise(s)," "comprising," "include(s)" and/or "including" may specify the presence of stated features, but may not preclude the presence and/or addition of one or more other features.

The term "connect" may mean "directly connect" or "indirectly connect." The term "connect" may mean "mechanically connect" and/or "electrically connect." The term "connected" may mean "electrically connected" or "electrically connected through no intervening transistor." The term "insulate" may mean "electrically insulate" or "electrically isolate." The term "conductive" may mean "electrically conductive." The term "drive" may mean "operate" or "control." The term "compensate" may mean "adjust." The term "compensation" may mean "adjustment." The term "offset" may mean "adjust" or "adjustment."

FIG. 1 is a block diagram illustrating a display device in accordance with embodiments.

Referring to FIG. 1, the display device 1000 may include a display unit 100, a first scan driver 200 (or first gate driver), a second scan driver 300 (or second gate driver), an emission driver 400 (or third gate driver), a data driver 500, an initialization power generator 600, and a timing controller 700.

The display device 1000 may display images at various driving frequencies according to driving conditions. The driving frequency is a frequency at which a data signal is substantially written to a driving transistor of a pixel PX. The driving frequency is also referred to as an image refresh rate, a screen refresh rate, a screen scan rate, or a screen refresh frequency, and represents a frequency at which a display screen is reproduced for one second. The display device 1000 may display images corresponding to various driving frequencies in a range of 1 Hz to 120 Hz.

The display unit 100 displays an image. The display unit 100 includes pixels PX connected to data lines D, scan lines S1 and S2, and emission control lines E. The pixels PX may be supplied with voltages of a first driving power source VDD and a second driving power source VSS shown in FIG. 2, and may be supplied with voltages of a first initialization power source Vint1 and a second initialization power source Vint2 from the initialization power generator 600.

The pixels PX may be connected to at least one first scan line S1, at least one second scan line S2, and at least one emission control line E, according to a pixel circuit structure.

The timing controller 700 may receive an input control signal and an input image signal from an image source, such as an external graphic device. The timing controller 700 may generate image data RGB suitable for an operation condition of the display unit 100 based on the input image signal, and may provide the generated image data RGB to the data driver 500. The timing controller 700 may generate a first driving control signal SCS1 for controlling a driving timing of the first scan driver 200, a second driving control signal SCS2 for controlling a driving timing of the second scan driver 300, a third driving control signal ECS for controlling a driving timing of the emission driver 400, and a fourth driving control signal DCS for controlling a driving timing of the data driver 500 based on the input control signal, and may provide the first driving control signal SCS1, the second driving control signal SCS2, the third driving control signal ECS, and the fourth driving control signal DCS respectively to the first scan driver 200, the second scan driver 300, the emission driver 400, and the data driver 500.

The first scan driver 200 may receive the first driving control signal SCS1 from the timing controller 700. The first scan driver 200 may supply one or more scan signals to first scan lines S1 in response to the first driving control signal SCS1.

The second scan driver 300 may receive the second driving control signal SCS2 from the timing controller 700. The second scan driver 300 may supply one or more scan signals to second scan lines in response to the second driving control signal SCS2.

The emission driver 400 may receive the third driving control signal ECS from the timing controller 700. The emission driver 400 may supply an emission control signal to the emission control lines E.

The initialization power generator 600 may receive an initialization power control signal ICS from the timing controller 700. The initialization power generator 600 may supply a voltage of an initialization power source to the display unit 100 in response to the initialization power control signal ICS. The initialization power source may include initialization power sources, e.g., the first initialization power source Vint1 and the second initialization power source Vint2, which respectively output voltages at different voltage levels. The initialization power source is for initializing the pixels PX. An anode electrode of the light emitting element of a pixel PX may be initialized by a voltage of the first initialization power source Vint1. A driving transistor included in the pixel PX may be initialized by a voltage of the second initialization power source Vint2. The initialization power source may provide a negative voltage.

Figure 2:
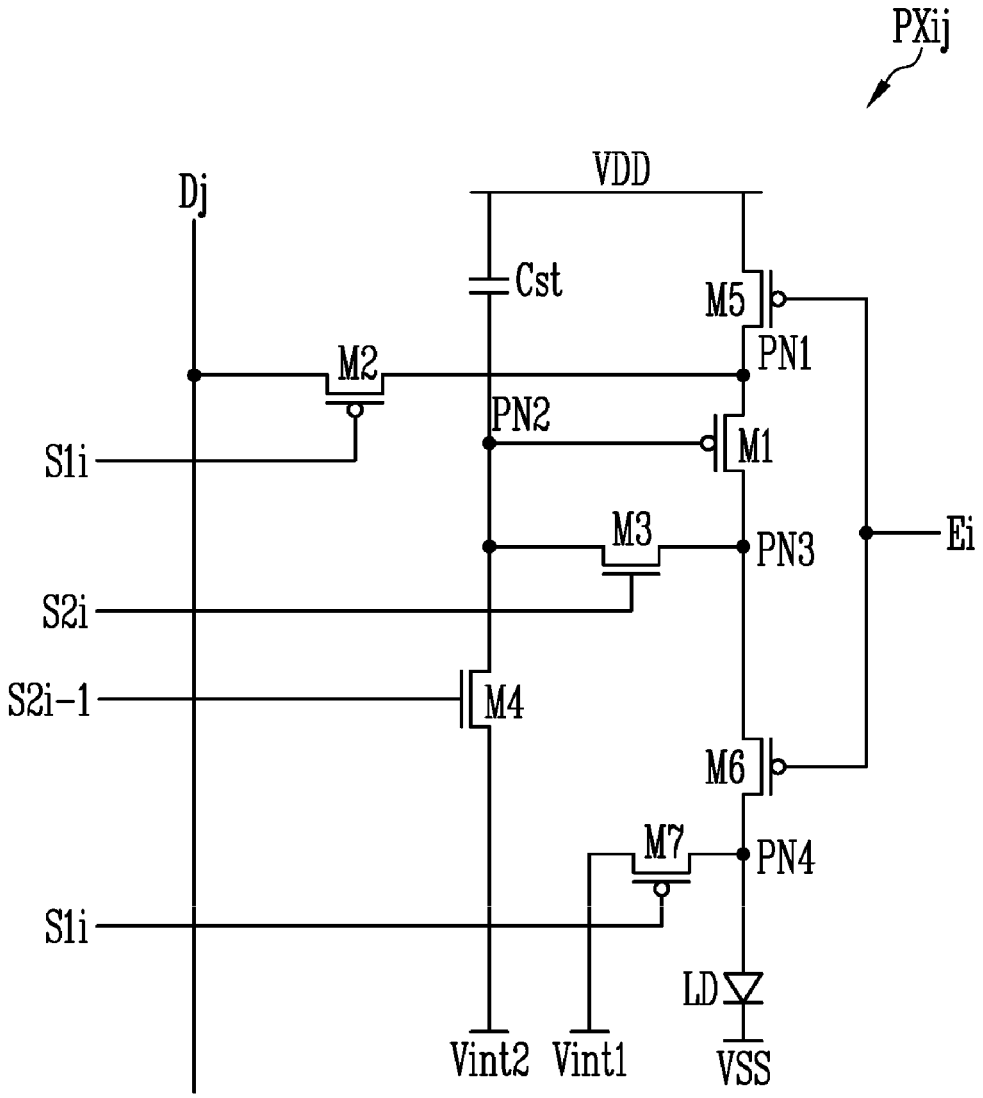
FIG. 2 is a circuit diagram illustrating a pixel included in the display device shown in FIG. 1 in accordance with embodiments.

FIG. 2 is a circuit diagram illustrating the pixel included in the display device shown in FIG. 1.

FIG. 2 illustrates, for convenience of description, a pixel PXij included in an ith ith pixel row and connected to a jth data line Dj (i and j are natural numbers).

Referring to FIG. 2, the pixel PXij may include a light emitting element LD, first to seventh pixel transistors M1 to M7, and a storage capacitor Cst.

A first electrode (anode electrode or cathode electrode) of the light emitting element LD is connected to a fourth pixel node PN4, and a second electrode (cathode electrode or anode electrode) of the light emitting element LD is connected to the second driving power source VSS. The light emitting element LD generates light with a luminance corresponding to an amount of current supplied from the first pixel transistor M1.

The light emitting element LD may be an organic light emitting diode including an organic light emitting layer. The light emitting element LD may be an inorganic light emitting element including an inorganic material. The light emitting element LD may include a combination of an inorganic material and an organic material. The light emitting element LD may include inorganic light emitting elements connected in parallel and/or series between the second driving power source VSS and the fourth pixel node PN4.

The first pixel transistor M1 (or driving transistor) is connected between a first pixel node PN1 and a third pixel node PN3. A gate electrode of the first pixel transistor M1 is connected to a second pixel node PN2. The first pixel transistor M1 may control an amount of current flowing from the first driving power source VDD to the second driving power source VSS via the light emitting element LD, according to a voltage of the second pixel node PN2. The voltage of the first driving power source VDD may be set higher than the voltage of the second driving power source VSS.

The second pixel transistor M2 is connected between the data line Dj and the first pixel node PN1. A gate electrode of the second pixel transistor M2 is connected to an ith first scan line S1*i*. The second pixel transistor M2 is turned on when a first scan signal is supplied to the ith first scan line S1*i*, to electrically connect the data line Dj and the first pixel node PN1 to each other.

The third pixel transistor M3 is connected between the third pixel node PN3 and the second pixel node PN2. A gate electrode of the third pixel transistor M3 is connected to an ith second scan line S2*i*. The third pixel transistor M3 is turned on when a second scan signal is supplied to the ith second scan line S2*i*. Therefore, when the third pixel transistor M3 is turned on, the first pixel transistor M1 is connected in a diode form.

The fourth pixel transistor M4 is connected between the second pixel node PN2 and the second initialization power source Vint2. A gate electrode of the fourth pixel transistor M4 is connected to an (i−1)th second scan line S2*i*−1. The fourth pixel transistor M4 is turned on when the second scan signal is supplied to the (i−1)th second scan line S2*i*−1, for supplying the voltage of the second initialization power source Vint2 to the second pixel node PN2. The voltage of the second initialization power source Vint2 is set lower than a voltage of a data signal supplied to the data line Dj.

Accordingly, a gate voltage of the first pixel transistor M1 may be initialized to the voltage of the second initialization voltage Vint2, and the first pixel transistor M1 may have an on-bias state (i.e., the first pixel transistor M1 is initialized to the on-bias state).

The fifth pixel transistor M5 is connected between the first driving power source VDD and the first pixel node PN1. A gate electrode of the fifth pixel transistor M5 is connected to an ith emission control line Ei. The fifth pixel transistor M5 is turned off when a high-level emission control signal is supplied to the ith emission control line Ei, and is turned on in other cases (e.g., when a low-level emission control signal is supplied to the ith emission control line Ei).

The sixth pixel transistor M6 is connected between the third pixel node PN3 and the first electrode of the light emitting element LD (i.e., the fourth pixel node PN4). A gate electrode of the sixth pixel transistor M6 is connected to the ith emission control line Ei. The sixth pixel transistor M6 is turned off when a high-level emission control signal is supplied to the ith emission control line Ei, and is turned on in other cases (e.g., when a low-level emission control signal is supplied to the ith emission control line Ei).

The fifth pixel transistor M5 and the sixth pixel transistor M6 may be connected to the same emission control line Ei or connected to different emission control lines.

The seventh pixel transistor M7 is connected between the first electrode of the light emitting element LD (i.e., the fourth pixel node PN4) and the first initialization power source Vint1. A gate electrode of the seventh pixel transistor M7 is connected to the ith first scan line S1*i*. The seventh pixel transistor M7 is turned on when the first scan signal is supplied to the ith first scan line S1*i*, to supply the voltage of the first initialization power source Vint1 to the first electrode of the light emitting element LD.

The gate electrode of the seventh pixel transistor M7 may be connected to the (i−1)th first scan line S1*i*−1 or an (i+1)th first scan line S1*i*+1.

The first initialization power source Vint1 and the second initialization power source Vint2 may provide different voltages. A voltage at which the second pixel node PN2 is initialized may be different from a voltage at which the fourth pixel node PN4 is initialized.

The storage capacitor Cst is connected between the first driving power source VDD and the second pixel node PN2. The storage capacitor Cst may store a voltage applied to the second pixel node PN2.

The first pixel transistor M1, the second pixel transistor M2, the fifth pixel transistor M5, the sixth pixel transistor M6, and the seventh pixel transistor M7 may be poly-silicon semiconductor transistors. Each of the first pixel transistor M1, the second pixel transistor M2, the fifth pixel transistor M5, the sixth pixel transistor M6, and the seventh pixel transistor M7 may include a poly-silicon semiconductor layer, as an active layer (including a channel), formed through a low temperature poly-silicon (LTPS) process. Each of the first pixel transistor M1, the second pixel transistor M2, the fifth pixel transistor M5, the sixth pixel transistor M6, and the seventh pixel transistor M7 may be a P-type transistor. Accordingly, a gate-on voltage for each of the first pixel transistor M1, the second pixel transistor M2, the fifth pixel transistor M5, the sixth pixel transistor M6, and the seventh pixel transistor M7 to turn on may have a low level (or logic low level).

Since the poly-silicon semiconductor transistor has an advantage of a fast response speed, the poly-silicon semiconductor transistor may be applied to a switching element which requires fast switching.

The third and fourth pixel transistors M3 and M4 may be oxide semiconductor transistors. Each of the third and fourth pixel transistors M3 and M4 may be an N-type oxide semiconductor transistor, and may include an oxide semiconductor layer as an active layer. Accordingly, a gate-on voltage for each of the third and fourth pixel transistors M3 and M4 to turn on may have a high level (or logic high level).

The oxide semiconductor transistor can be formed through a low temperature process, and may have charge mobility lower than that of a poly-silicon semiconductor transistor. The oxide semiconductor transistor has an excellent off-current characteristic. Because the third and fourth pixel transistors M3 and M4 are oxide semiconductor transistors, leakage current from the second pixel node PN2 and/or the third pixel node PN3 can be minimized. Advantageously, the display quality of the display device can be satisfactory.

Each of the second scan lines S2$i$−1 and S2$i$ may be connected to two or more pixel rows in addition to the ith pixel row. Accordingly, an initialization operation of a gate voltage of first pixel transistors M1 of pixels disposed in pixel rows and/or a compensation operation of a threshold voltage of the first pixel transistors M1 can be simultaneously performed.

Figure 3:
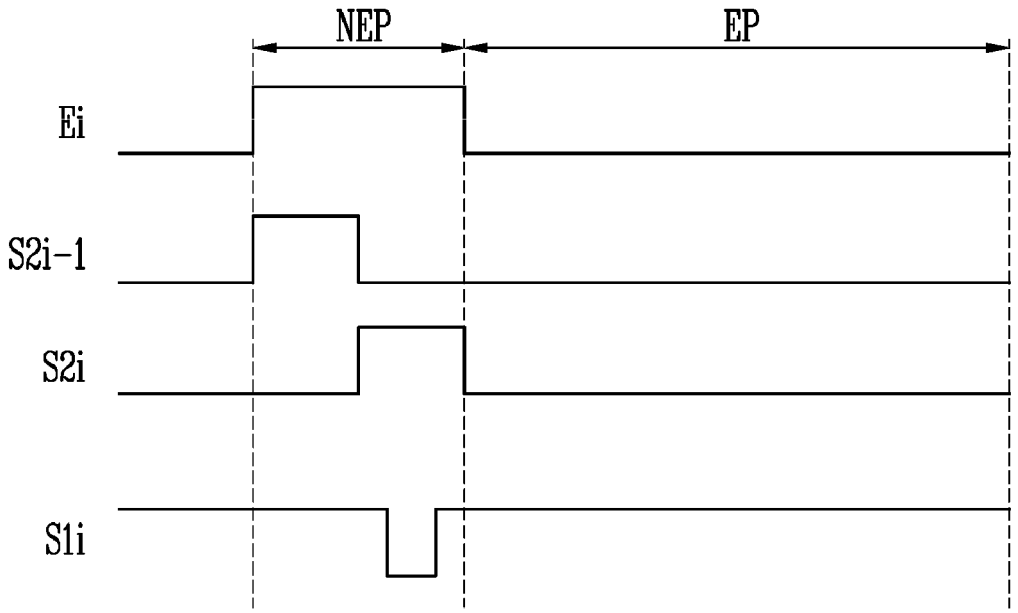
FIG. 3 is a timing diagram illustrating driving of the pixel shown in FIG. 2 in accordance with embodiments.

FIG. 3 is a timing diagram illustrating driving of the pixel shown in FIG. 2.

Referring to FIGS. 1 to 3, the pixel PXij may be supplied with signals for image display in a non-emission period NEP, and may emit light based on the signals in an emission period EP.

A gate-on voltage of the second scan signal supplied to the ith and (i−1)th second scan lines S2$i$ and S2$i$−1 connected to the third and fourth pixel transistors M3 and M4 (N-type transistors) has a high level. A gate-on voltage of the first scan signal supplied to the ith first scan line S1$i$ connected to the second and seventh pixel transistors M2 and M7 (P-type transistors) has a low level. A gate-on voltage of the emission control signal supplied to the ith emission control line Ei connected to the fifth and sixth pixel transistors M5 and M6 (P-type transistors) has the low level.

A high-level emission control signal is supplied to the ith emission control line Ei. When the high-level emission control signal is supplied to the ith emission control line Ei, the fifth and sixth pixel transistors M5 and M6 are turned off. When the fifth and sixth pixel transistors M5 and M6 are turned off, the pixel PXij is in a non-emission state.

A second scan signal is supplied to the (i−1)th second scan line S2$i$−1. When the second scan signal is supplied to the (i−1)th second scan line S2$i$−1, the fourth pixel transistor M4 is turned on. When the fourth pixel transistor M4 is turned on, the voltage of the second initialization power source Vint2 is supplied to the second pixel node PN2.

Subsequently, the first and second scan signals are respectively supplied to the ith first scan line S1$i$ and the ith second scan line S2$i$. When the second scan signal is supplied to the ith second scan line S2$i$, the third pixel transistor M3 is turned on. When the third pixel transistor M3 is turned on, the first pixel transistor M1 is connected in the diode form, and the threshold voltage of the first pixel transistor M1 can be adjusted and/or compensated.

When the first scan signal is supplied to the ith first scan line S1$i$, the second pixel transistor M2 is turned on. When the second pixel transistor M2 is turned on, a data signal from the data line Dj is supplied to the first pixel node PN1. Since the second pixel node PN2 is initialized to the voltage of the second initialization power source Vint2, which is lower than the voltage of the data signal (e.g., the second pixel node PN2 is initialized to the on-bias state), the first pixel transistor M1 is turned on.

When the first pixel transistor M1 is turned on, the data signal supplied to the first pixel node PN1 is supplied to the second pixel node PN2 via the first pixel transistor M1 connected in the diode form. Therefore, a voltage corresponding to the data signal and the threshold voltage of the first pixel transistor M1 is applied to the second pixel node PN2. The storage capacitor Cst stores the voltage of the second pixel node PN2.

Because the first scan signal is supplied to the ith first scan line S1$i$, the seventh pixel transistor M7 is turned on. When the seventh pixel transistor M7 is turned on, the voltage of the first initialization power source Vint1 is supplied to the first electrode of the light emitting element LD (i.e., the fourth pixel node PN4). Accordingly, a residual voltage remaining in a parasitic capacitor associated with the light emitting element LD can be discharged.

Subsequently, the supply of the high-level emission control signal to the ith emission control line Ei is suspended. When the supply of the high-level emission control signal to the ith emission control line Ei is suspended, the fifth and the sixth pixel transistors M5 and M6 are turned on. The first pixel transistor M1 controls a driving current flowing through the light emitting element LD, corresponding to the voltage of the second pixel node PN2. As a result, the light emitting element LD generates light with a luminance corresponding to an amount of driving current.

Although a case where a width of the second scan signal may or may not be greater than a width of the first scan signal.

Characteristics of a moving image may vary according to a difference between the voltage of the first initialization power source, which is supplied to the first electrode (anode electrode or cathode electrode) of the light emitting element LD, and the voltage of the second driving power source VSS, which is supplied to the second electrode (cathode electrode or anode electrode) of the light emitting element LD. For example, when the voltage of the first initialization power source Vint1 is excessive in a forward bias direction, black may be displayed in a first frame just after transition. When the voltage of the first initialization power source Vint1 is excessive in a reverse bias direction, light emission of the first frame just after the transition is delayed. Therefore, luminance may be lowered, or a color dragging phenomenon may occur. If the voltage of the first initialization power source Vint1 is not properly adjusted, as a light emission characteristic of the light emitting element is changed according to the voltage of the first initialization power source Vint1, the quality of the moving image may be undesirably affected. In particular, the undesirable effects on the moving image may be significant in a low luminance and low grayscale area.

According to embodiments, an image is analyzed for each frame, an offset voltage (or adjustment voltage) is set corresponding to the analyzed image, and then the voltage of the first initialization power source Vint1 is changed and output during a first frame period of a changed image by applying the offset voltage, so that the characteristics of the moving image can be improved. The voltage of the first initialization power source Vint1 may be adjusted by applying the offset voltage during the first frame period of the changed image, and a reference voltage is output as the voltage of the first initialization power source Vint1 during a next frame period when the image is not changed, so that power consumption can be minimized.

Figure 4:
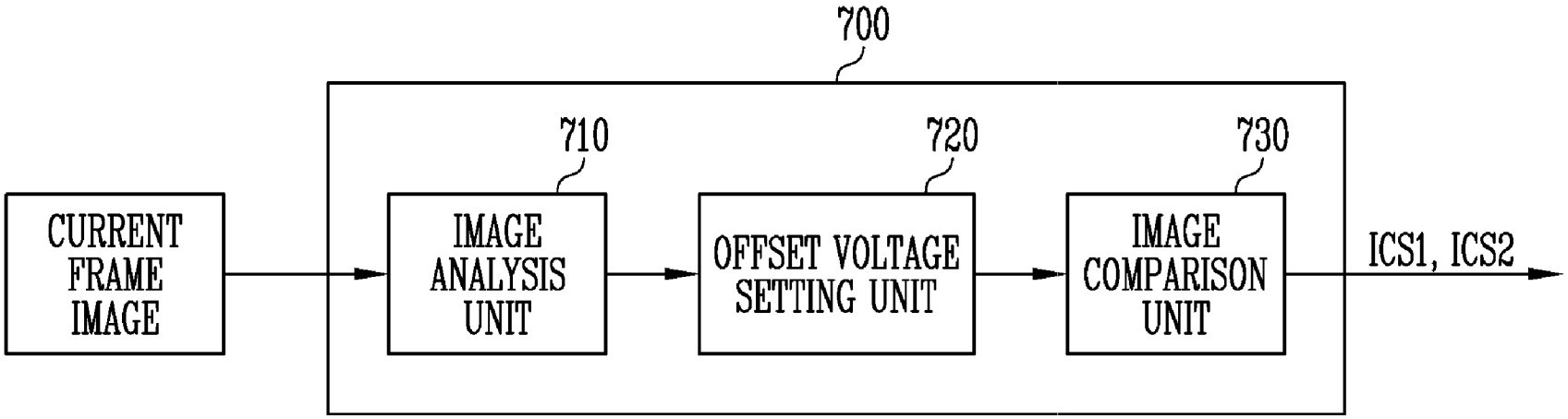
FIG. 4 illustrates a timing controller included in the display device shown in FIG. 1 in accordance with embodiments.

FIG. 4 illustrates the timing controller included in the display device shown in FIG. 1.

Referring to FIG. 4, the timing controller 700 includes an image analysis unit 710, an offset voltage setting unit 720 (or adjustment voltage setting unit 720), and an image comparison unit 730.

The image analysis unit 710 analyzes an image for each frame.

The image analysis unit 710 may calculate an Average Picture Level (APL) and a black rate of a current frame. The APL means an average brightness of an image, and the black rate means a rate at which black occupies in an image. For example, in a frame of an image representing a black grayscale, the APL may be 0%, and the black rate may be 100%.

The image analysis unit 710 may further calculate an APL and a black rate of at least one previous frame in addition to the current frame. The image analysis unit 710 may calculate an APL and a black rate of each of the current frame ((N−1)th frame) and one previous frame ((N−2)th frame), or calculate an APL and a black rate of each of the current frame ((N−1)th frame) and a plurality of previous frames ((N−2)th, (N−3)th, and (N−4)th frames). A number of the at least one previous frame on which calculation is additionally performed in the image analysis unit 710 may be predetermined.

The offset voltage setting unit 720 sets an offset voltage (or adjustment voltage) based on a result of the image analysis unit 710. The offset voltage is applied to the voltage of the first initialization power source Vint1 to adjust the voltage of the first initialization power source Vint1. The offset voltage may be added to the voltage of the first initialization power source Vint1 to increase the voltage of the first initialization power source Vint1, or may be subtracted from the voltage of the first initialization power source Vint1 to decrease the voltage of the first initialization power source Vint1. Offset voltage values may be predetermined to correspond to each of APL values/ranges and black rate values/ranges.

FIG. 5 is a table illustrating offset voltage values corresponding to ranges of APL values and black rate values possibly resulted from an image calculation.

Referring to FIG. 5, possible APL values may be divided into four sections/ranges, and an offset voltage may be predetermined to correspond to each section. Possible black rate values may be divided into four sections/ranges, and an offset voltage may be predetermined to correspond to each section. The values of the APL and the black rate may be further divided into sub-sections, and an offset voltage may be predetermined to correspond to each sub-section.

The offset voltage setting unit 720 sets an offset voltage by selecting one of the predetermined offset voltages corresponding to the APL and the black rate of the current frame, which are calculated in the image analysis unit 710. The offset voltage setting unit 720 may set the larger value among the two predetermined offset voltages corresponding to the calculated APL and the calculated black rate as the offset voltage. The offset voltage setting unit may set, the smaller values among the two predetermined offset voltages corresponding to the calculated APL and the calculated black rate as the offset voltage value. For example, referring to FIG. 5, when the calculated APL is 0% and the calculated black rate is 100%, a predetermined offset value corresponding to the calculated APL is 0.5 V, and a predetermined offset value corresponding to the calculated black rate is 0.2 V. Therefore, 0.5 V, the larger value selected from 0.5 V and 0.2 V, may be set as the offset voltage.

The offset voltage setting unit 720 may select offset voltages corresponding to the APLs and the black rates of the current frame and the at least one previous frame, which are calculated in the image analysis unit 710, according to the table provided in FIG. 5 and may set an offset voltage by multiplying the selected offset voltages by a predetermined weight and then adding the offset voltages multiplied by the predetermined weight together.

FIG. 6 is a table illustrating an offset voltage corresponding to values resulted from an image calculation.

Referring to FIG. 6, the offset voltage setting unit 720 may set an offset voltage by multiplying selected offset voltages by weights to calculate weighted offset values and then adding the weighted offset voltages. For example, a weight with respect to a current frame ((N−1)th frame) may be predetermined as 40%, and weights with respect to previous frames ((N−2)th, (N−3)th, (N−4)th, and (N−5)th frames) may be respectively predetermined as 30%, 10%, 10%, and 10%.

The image comparison unit 730 (shown in FIG. 4) may check whether images of the current frame and a next frame are identical or different, and may generate an initialization power control signal ICS for controlling the voltage of the first initialization power source Vint1 and then transfer the generated initialization power control signal ICS to the initialization power generator 600 (shown in FIG. 1).

The initialization power control signal ICS generated in the image comparison unit 730 may include a first initialization power control signal ICS1 corresponding to an image change and/or a second initialization power control signal ICS2 corresponding to image consistency. When the images of the current frame and the next frame are different, the image comparison unit 730 may generate the first initialization power control signal ICS1 for adjusting the voltage of the first initialization power source Vint1 by applying the offset voltage set in the offset voltage setting unit 720. When the images of the consecutive frames are identical, the image comparison unit 730 may generate the second initialization power control signal ICS2 for controlling a reference voltage as the voltage of the first initialization power source Vint1, regardless of the offset voltage set in the offset voltage setting unit 720, and then transfer the second initialization power control signal ICS2 to the initialization power generator 600.

The initialization power generator 600 receives the initialization power control signal ICS1 or ICS2 from the timing controller 700 to generate and output the voltage of the first initialization power source Vint1.

When the images of the two consecutive frames are different, the initialization power generator 600 may receive the first initialization power control signal ICS1 to add the offset voltage to the reference voltage to generate an adjusted voltage during a first frame period of the changed image and then output the adjusted voltage as the voltage of the first initialization power source Vint1. When the images of the two consecutive frames are identical, the initialization power generator 600 may receive the second initialization power control signal ICS2 to output the reference voltage as the voltage of the first initialization power source Vint1 during a next frame period.

The first frame may immediately precede a frame of a changed image.

Figure 7A:
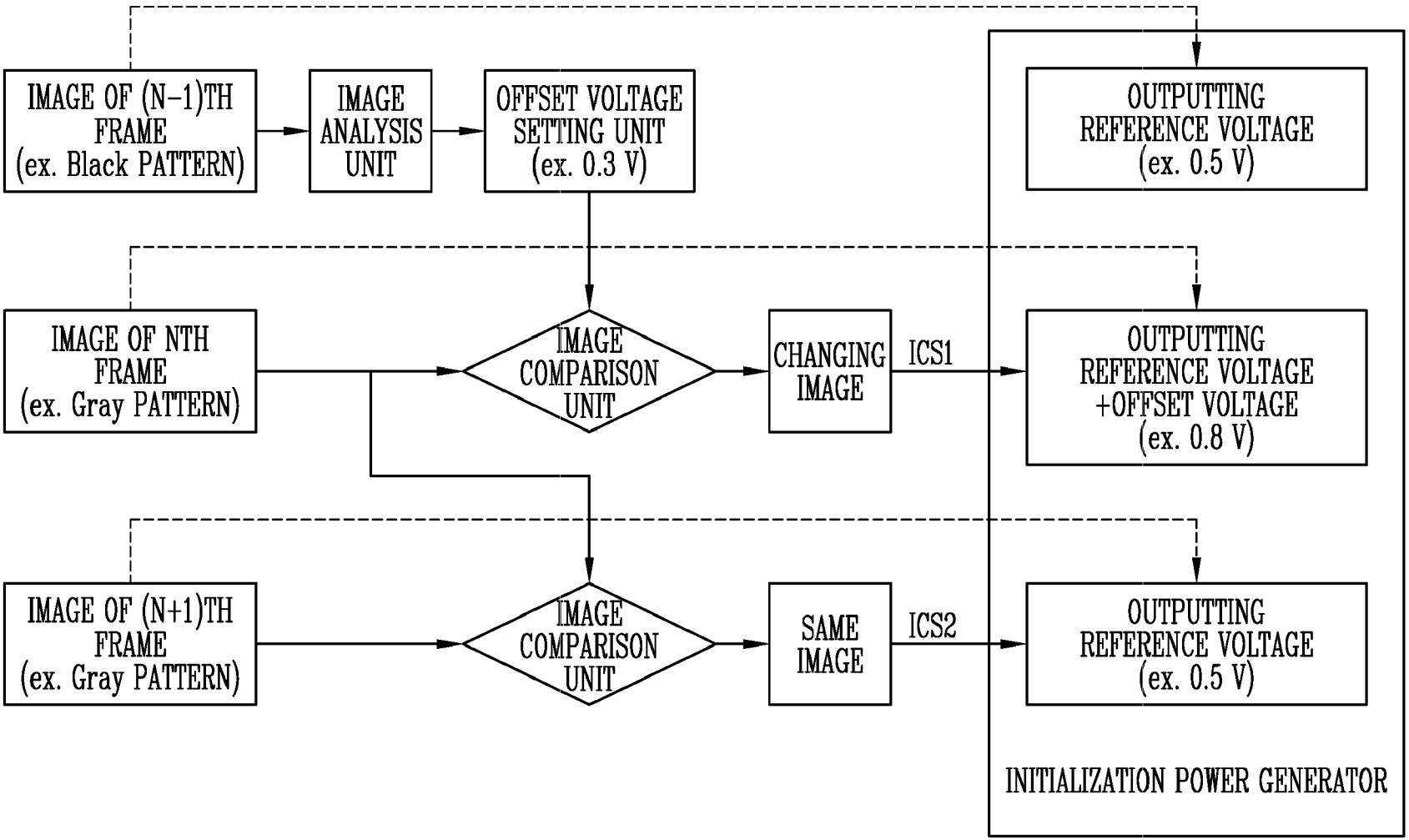
FIG. 7A illustrates an operation of an initialization power generator included in the display device shown in FIG. 1 in accordance with embodiments.
Figure 7B:
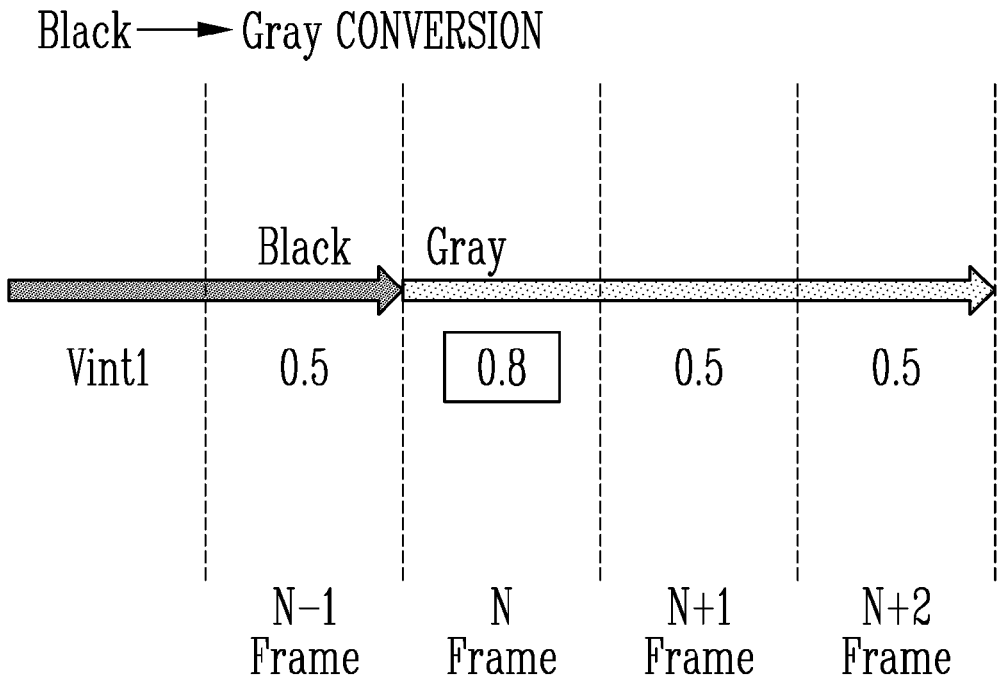
FIG. 7B illustrates a voltage of a first initialization power source for each frame of four consecutive frames according to FIG. 7A in accordance with embodiments.

FIG. 7A illustrates an operation of the initialization power generator 600 included in the display device shown in FIG. 1. FIG. 7B illustrates a voltage of the first initialization power source for each frame of four consecutive frames according to FIG. 7A.

Referring to FIGS. 7A and 7B, the image in the current frame ((N−1)th frame) is a black image/pattern; the image in the next frame (Nth frame) is changed to a gray image/pattern; the voltage of the first initialization power source Vint1 of the current frame ((N−1)th frame) corresponding to the black image is the reference voltage (0.5 V); the initialization power generator 600 may output, as the voltage of the first initialization power source Vint1, an adjusted voltage (0.8 V) obtained by adding an offset voltage (0.3 V) to the reference voltage (0.5 V) during the Nth frame (i.e., the first frame period of the image change) according to the first initialization power control signal ICS1 received from the image comparison unit 730. The image of the next frame ((N+1)th frame) of the Nth frame may remain the same gray image as the image of the Nth frame; the initialization power generator 600 may again output, as the voltage of the first initialization power source Vint1 of the (N+1)th frame, the reference voltage (0.5 V) according to the second initialization power control signal ICS2 received from the image comparison unit 730.

The initialization power generator 600 may further include an adder (not shown) for adding an offset voltage to a reference voltage according to the first initialization power control signal ICS1 received from the image comparison unit 730 and/or a subtractor (not shown) for outputting a reference voltage by decreasing a voltage according to the second initialization power control signal ICS2 transferred from the image comparison unit 730.

Figure 8:
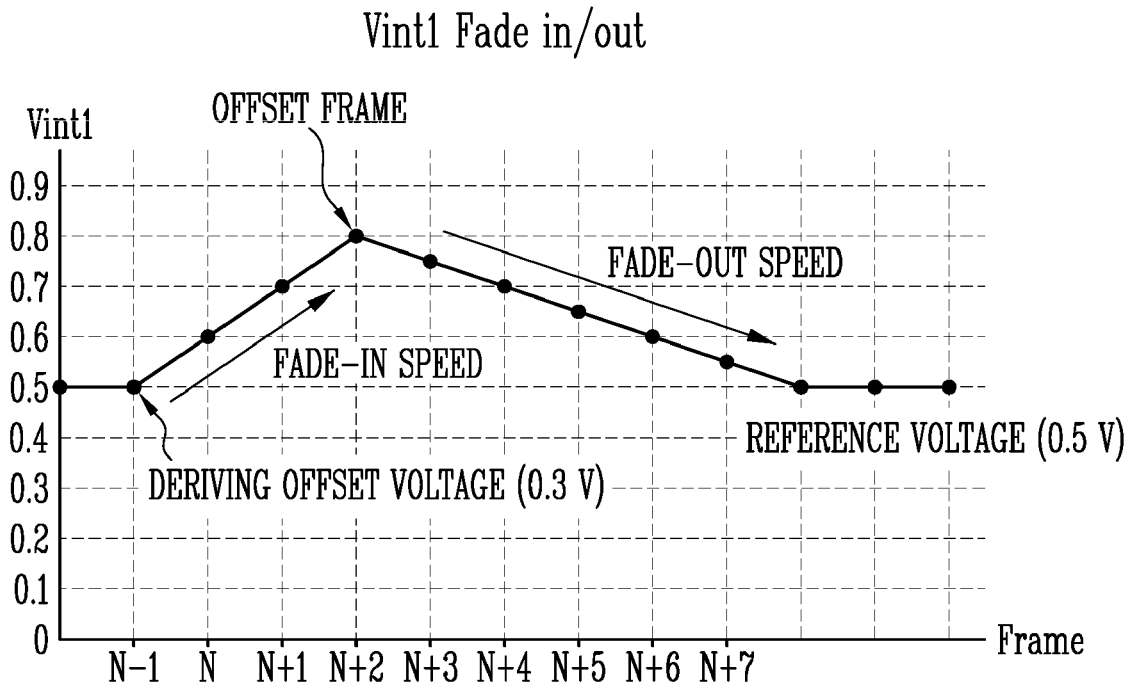
FIG. 8 is a diagram illustrating an operation of the initialization power generator included in the display device shown in FIG. 1 in accordance with embodiments.

FIG. 8 is a diagram illustrating the operation of the initialization power generator included in the display device shown in FIG. 1 according to embodiments.

Referring to FIG. 8, when the first initialization power control signal ICS1 corresponding to the image change is received from the image comparison unit 730, the initialization power generator 600 may change and output the voltage of the first initialization power source Vint1 during at least two frame periods including a first frame of the changed image. The voltage of the first initialization power source Vint1 may be changed as adjustments less than or equal to an offset voltage set in the offset voltage setting unit 720 are differentially applied to the voltages of the first initialization power source Vint1 according to the APL values of the at least two frame periods.

The initialization power generator 600 may gradually increase the voltage of the first initialization power source Vint1 until a predetermined offset frame (or adjustment frame). The voltage of the first initialization power source Vint1 may increase at a predetermined slope. The slope means an increase (fade-in) speed of the voltage of the first initialization power source Vint1, and may be adjusted according to the offset voltages differentially applied during different frame periods. For example, as adjustments less than or equal to the offset voltage (0.3 V) set from the current frame ((N−1)th frame) are differentially applied according to the APL values of the next three frames (Nth, (N+1)th, and (N+2)th frames), 0.1 V may be applied for each of the Nth frame, 0.2 V may be applied to the (N+1)th frame, and 0.3 V may be applied to the (N+2)th frame.

Therefore, for the next three frames, the initialization power generator 600 may respectively output 0.6 V, 0.7 V, and 0.8 V as the voltages of the first initialization power source Vint1. The slope may be 0.1 V/frame.

The initialization power generator 600 may add the offset voltage set in the offset voltage setting unit 720 to the reference voltage to generate an adjusted voltage and output the adjusted voltage as the voltage of the initialization power source Vint1 during a predetermined offset frame period.

The initialization power generator 600 may gradually decrease the voltage of the first initialization power source Vint1 down to the reference voltage during at least two frame periods after the predetermined offset frame. The voltage of the first initialization power source Vint1 may decrease at a predetermined slope. The slope means a decrease (fade-out) speed of the voltage of the first initialization power source Vint1, and may be adjusted according to offset voltages differentially applied during consecutively frames. For example, as adjustment less than or equal to the offset voltage (0.3 V) set from the current frame ((N−1)th frame) are differentially applied according to the APL values of the next five frames ((N+3)th, (N+4)th, (N+5)th, (N+6)th, and (N+7)th frames) of the offset frame ((N+2)th frame), 0.05 V may be applied to the (N+3)th frame, 0.10 V may be applied to the (N+4)th frame, 0.15 V may be applied to the (N+5)th frame, 0.20 V may be applied to the (N+6)th frame, and 0.25 V may be applied to the (N+7)th frame. Therefore, for the next five frames, the initialization power generator 600 may respectively output 0.75 V, 0.70 V, 0.65 V, 0.60 V, and 0.55 V as the voltages of the first initialization power source Vint1. The slope may be −0.05 V/frame.

Figure 9:
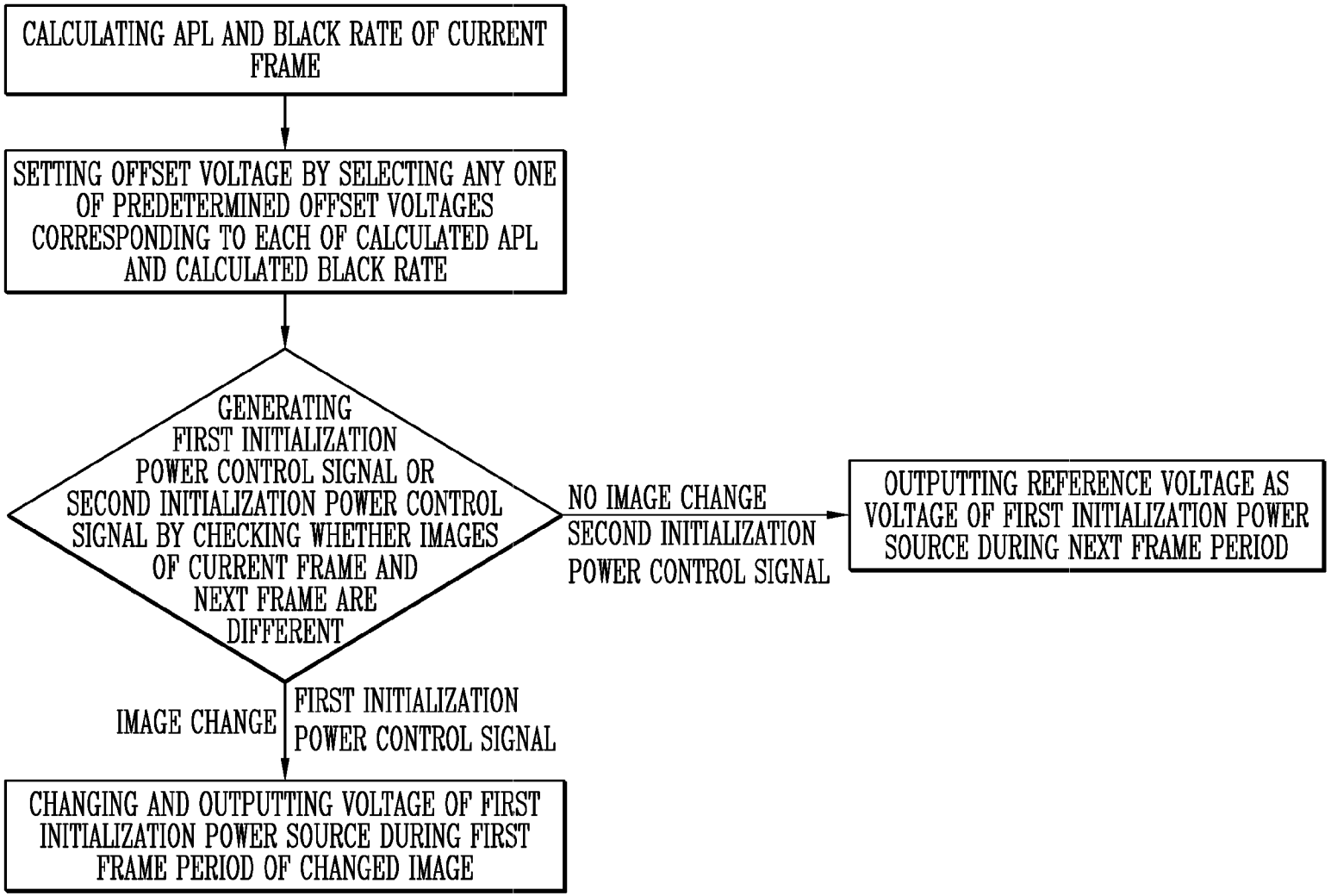
FIG. 9 is a flowchart illustrating a driving method of a display device in accordance with embodiments.

FIG. 9 is a flowchart illustrating a driving method of a display device in accordance with embodiments.

Referring to FIG. 9, the driving method may related to initializing a light emitting element of a pixel using a voltage of a first initialization power source Vint1. The driving method may include a first step of calculating an APL and a black rate of a current frame, a second step of setting an offset voltage by selecting one of predetermined offset voltages corresponding to each of the calculated APL and the calculated black rate, a third step of generating a first initialization power control signal ICS1 or a second initialization power control signal ICS2 by checking whether images of the current frame and a next frame are different or identical, and a fourth step of, when/if the images are different (i.e., there is an image change), changing and outputting the voltage of the first initialization power source Vint1 during a first frame period of the changed image according to the first initialization power control signal ICS1.

The voltage of the first initialization power source Vint1 may initialize an anode electrode of the light emitting element.

Regarding the first step, methods of calculating one or more APL values and one or more black rate values are described above.

Regarding the second step, methods of setting the offset voltage according to one or more calculation results are described above.

The third step may include generating the first initialization power control signal ICS1 or the second initialization power control signal ICS2 by checking whether images of the current frame and a next frame are different or identical. When/if the images are different (i.e., there is an image change), the first initialization power control signal ICS1 may be generated. When/if the image are identical (i.e., there is no image change), the second initialization power control signal ICS2 may be generated.

The fourth step may include changing and outputting the voltage of the first initialization power source Vint1 during a first frame period of the changed image according to the first initialization power control signal ICS1.

In the fourth step, the offset voltage is added to a reference voltage to generate an adjusted voltage during the first frame period of the changed image, and the adjusted voltage may be output as the voltage of the first initialization power source Vint1.

When/if the images are identical (i.e., there is no image change), in a fifth step, the reference voltage may be output as the voltage of the first initialization power source Vint1 according to the second initialization power control signal ICS2 during a next frame period.

In the fourth step, the voltage of the first initialization power source Vint1 may be changed and output during at least two frame periods including the first frame of the changed image. For example, in the fourth step, the voltage of the first initialization power source Vint1 may be gradually increased until a predetermined offset frame. During a predetermined offset frame period, an offset voltage may be added to the reference voltage to generate an adjusted voltage, and the adjusted voltage may be output as the voltage of the first initialization power source Vint1. In the fourth step, the voltage of the first initialization power source Vint1 may be gradually decreased down to the reference voltage during at least two frame periods after the predetermined offset frame.

Unlike a conventional art in which a constant voltage of the first initialization power source Vint1 is output for each model regardless of whether an image of a frame has been changed, according to embodiments, the voltage of the first initialization power source Vint1 is adjusted during a first frame period of a changed image. Thus, a problem that black is untimely displayed or light emission is delayed can be prevented. Advantageously, the quality of moving images displayed by a display device may be satisfactory.

In embodiments, image (or data) for consecutive frames are compared, and a first initialization voltage for initializing an anode electrode of a light emitting element may be adjusted and output according to whether there is an image change, so that luminance deterioration and light emission delay can be prevented. Advantageously, the quality of moving images displayed by a display device may be satisfactory.

Example embodiments have been disclosed. Although specific terms are employed, they are used and are to be interpreted in a generic and descriptive sense and not for purpose of limitation. Features, characteristics, and/or elements described in connection with a particular embodiment may be used singly or in combination with features, characteristics, and/or elements described in connection with other embodiments unless otherwise specifically indicated. Various changes in form and details may be made to the disclosed example embodiments without departing from the scope set forth in the following claims.

What is claimed is:

1. A display device comprising:

a light emitting element;

a timing controller configured to determine whether a second image associated with a second frame is different from a first image associated with a first frame, the second frame immediately following the first frame; and an initialization power generator electrically connected to the timing controller, configured to provide a reference voltage for initializing the light emitting element in the second frame when the second image is identical to the first image, and configured to provide a first adjusted voltage unequal to the reference voltage for initializing the light emitting element in the second frame when the second image is different from the first image.

2. The display device of claim 1, wherein the reference voltage or the first adjusted voltage initializes an anode electrode of the light emitting element.

3. The display device of claim 1, wherein the timing controller includes:

an image analysis unit configured to calculate an average brightness value of the first image and a black rate of the first image;

an adjustment voltage setting unit configured to determine a first adjustment voltage by at least selecting one adjustment voltage corresponding to each of the average brightness value of the first image and the black rate of the first image, wherein the first adjusted voltage is a function of the reference voltage and the first adjustment voltage; and an image comparison unit configured to generate a first signal when the second image is different from the first image and configured to generate a second signal when the second image is identical to the first image.

4. The display device of claim 3, wherein the image analysis unit further calculates at least one average brightness value and at least one black rate of at least a third image associated with at least one frame preceding the first frame, and wherein the adjustment voltage setting unit selects at least one adjustment voltage corresponding to each of the at least one average brightness value and the at least one black rate, multiples selected adjustment voltages associated with the first image and at least the third image by predetermined weights to calculate weighted adjustment voltages, and then adds the weighted adjustment voltages to obtain the first adjustment voltage.

5. The display device of claim 3, wherein, in response to the first signal received from the image comparison unit, the initialization power generator adds the first adjustment voltage to the reference voltage to obtain the first adjusted voltage.

6. The display device of claim 5, wherein, in response to the second signal received from the image comparison unit, the initialization power generator outputs the reference voltage in the second frame.

7. The display device of claim 3, wherein, in response to the first signal received from the image comparison unit, the initialization power generator outputs the first adjusted voltage and a second adjusted voltage for the second frame and a third frame, respectively, the third frame being subsequent to the second frame, the second adjusted voltage being unequal to each of the reference voltage and the first adjusted voltage.

8. The display device of claim 7, wherein the first adjusted voltage is greater than the reference voltage, and wherein the second adjusted voltage is greater than the first adjusted voltage.

9. The display device of claim 8, wherein the initialization power generator adds different adjustments that are less than or equal to a predetermined adjustment voltage to the reference voltage to generate different adjusted voltages for initializing the light emitting element with the different adjusted voltages in the second frame and at least the third frame.

10. The display device of claim 8, wherein the initialization power generator subtracts different deductions that are less than or equal to the predetermined adjustment voltage from the second adjusted voltage to generate different reduced voltages for initializing the light emitting element during at least two frames that are subsequent to the third frame.

11. A method of driving a display device including a light emitting element, the method comprising:

calculating an average brightness value of a first image and a black rate of the first image, the first image being associated with a first frame;

determining a first adjustment voltage by at least selecting one adjustment voltage corresponding to each of the average brightness value of the first image and the black rate of the first image;

determining whether a second image associated with a second frame immediately following the first image is different from the first image;

generating a first signal when the second image is different from the first image, or generating a second signal when the second image is identical to the first image; and providing a reference voltage for initializing the light emitting element in the second frame in response to the second signal, or providing a first adjusted voltage unequal to the reference voltage for initializing the light emitting element in the second frame in response to the first signal.

12. The method of claim 11, wherein the reference voltage or the first adjusted voltage initializes an anode electrode of the light emitting element.

13. The method of claim 11, comprising: calculating at least one average brightness value and at least one black rate of at least a third image associated with at least one frame preceding the first frame;

selecting at least one adjustment voltage corresponding to each of the at least one average brightness value and the at least one black rate;

multiplying selected adjustment voltages associated with the first image and at least the third image by predetermined weights to calculate weighted adjustment voltages; and adding the weighted adjustment voltages to obtain a first adjustment voltage, wherein the first adjusted voltage is a function of the reference voltage and the first adjustment voltage.

14. The method of claim 11, comprising: adding a first adjustment voltage to the reference voltage to obtain the first adjusted voltage in response to first signal.

15. The method of claim 14, comprising: providing the reference voltage for initializing the light emitting element when a third image associated with a third frame immediately following the second frame is identical to the second image.

16. The method of claim 11, comprising: in response to the first signal, outputting the first adjusted voltage and a second adjusted voltage for the second frame and a third frame, respectively, the third frame being subsequent to the second frame, the second adjusted voltage being unequal to each of the reference voltage and the first adjusted voltage.

17. The method of claim 16, wherein the first adjusted voltage is greater than the reference voltage, and wherein the second adjusted voltage is greater than the first adjusted voltage.

18. The method of claim 17, comprising: adding different adjustments that are less than or equal to a predetermined adjustment voltage to the reference voltage to generate different adjusted voltages for initializing the light emitting element with the different adjusted voltages in the second frame and at least the third frame.

19. The method of claim 17, comprising: subtracting different reductions that are less than or equal to the predetermined adjustment voltage from the second adjusted voltage to generate different reduced voltages for initializing the light emitting element during at least two frames that are subsequent to the third frame.

* * * * *